US007371043B2

(12) United States Patent
Keller

(10) Patent No.: US 7,371,043 B2
(45) Date of Patent: May 13, 2008

(54) CMC TURBINE SHROUD RING SEGMENT AND FABRICATION METHOD

(75) Inventor: Douglas A. Keller, Oviedo, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 235 days.

(21) Appl. No.: 11/330,597

(22) Filed: Jan. 12, 2006

(65) Prior Publication Data

US 2007/0160466 A1 Jul. 12, 2007

(51) Int. Cl.
*F01D 11/08* (2006.01)

(52) U.S. Cl. ..... 415/173.1; 415/173.4

(58) Field of Classification Search ..... 415/173.1, 415/173.4, 174.4
See application file for complete search history.

(56) References Cited

U.S. PATENT DOCUMENTS

| | | | |
|---|---|---|---|
| 4,808,461 | A | 2/1989 | Boyce et al. |
| 4,875,616 | A | 10/1989 | Nixdorf |
| 5,331,816 | A | 7/1994 | Able et al. |
| 5,466,506 | A | 11/1995 | Freitas et al. |
| 5,589,015 | A | 12/1996 | Fusco et al. |
| 5,789,061 | A | 8/1998 | Campbell et al. |
| 6,190,602 | B1 | 2/2001 | Blaney et al. |
| 6,280,584 | B1 | 8/2001 | Kumar et al. |
| 6,315,519 | B1 | 11/2001 | Bagepalli et al. |
| 6,325,593 | B1 | 12/2001 | Darkins, Jr. et al. |
| 6,451,416 | B1 | 9/2002 | Holowczak et al. |
| 6,648,597 | B1 | 11/2003 | Widrig et al. |
| 6,702,550 | B2 | 3/2004 | Darkins, Jr. et al. |
| 6,709,230 | B2 | 3/2004 | Morrison et al. |
| 6,758,653 | B2 | 7/2004 | Morrison |
| 6,767,659 | B1 | 7/2004 | Campbell |

*Primary Examiner*—Edward K. Look
*Assistant Examiner*—Nathan Wiehe

(57) ABSTRACT

Fabricating a refractory component for a gas turbine engine, such as a turbine shroud ring segment, by arranging refractory fiber tows (24) in a flaired tubular geometry (20) comprising a stem portion (21) and a funnel-shaped portion (22); impregnating the refractory fibers (24) with a ceramic matrix to form a flaired tube (20) of ceramic composite matrix material; at least partially filling the funnel-shaped portion (22) with a ceramic core (30) extending beyond the end of the funnel-shaped portion to provide a working gas containment surface (31); curing the flaired tube (20) and the ceramic core (30) together; cutting the funnel-shaped portion (22) to provide rectangular edges (27); and providing an attachment mechanism (34, 36, 38, 40) on the stem portion (21) for attaching the component to a surrounding support structure. Additional tows (24) may be introduced at intermediate stages to maintain a desired fabric density.

19 Claims, 5 Drawing Sheets

FIG 4
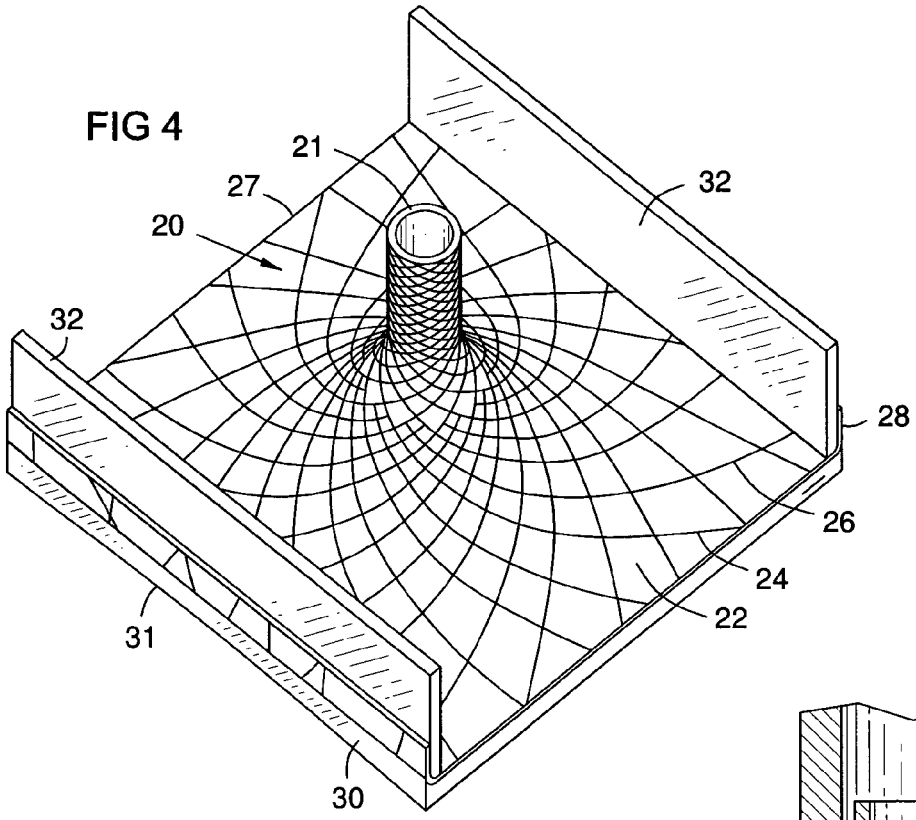
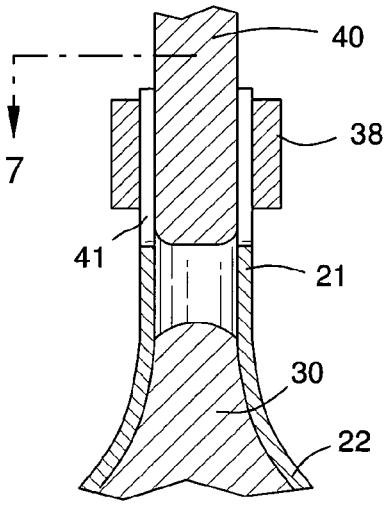
FIG 6
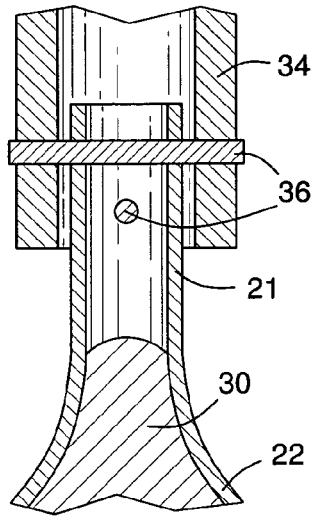
FIG 5
FIG 7
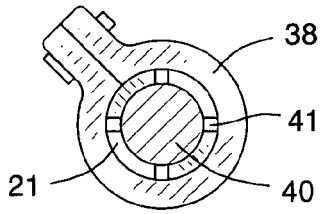

CMC TURBINE SHROUD RING SEGMENT AND FABRICATION METHOD

FIELD OF THE INVENTION

This invention relates generally to the field of gas turbine engines, and more particularly to the use of ceramic matrix composites in a combustion turbine engine.

BACKGROUND OF THE INVENTION

A turbine section of a gas turbine engine has a rotating shaft with circular arrays of radially oriented aerodynamic blades mounted around the circumferences of disks on the shaft. Closely surrounding these blades is a metallic shroud that contains the flow of hot combustion gasses passing through the engine. This shroud must withstand temperatures of over 1300° C. reliably over a long life span. Close spatial tolerances must be maintained in the gap between the blade tips and the shroud for engine efficiency. However, the shroud, blades, disks, and their connections are subject to wide temperature changes during variations in engine operation, including engine shutdowns and restarts. The shroud must insulate the engine case from combustion heat, and it must be durable and abrasion tolerant to withstand occasional rubbing contact with the blade tips.

Ceramics are known to be useful in the inner lining of shrouds to meet these requirements. A shroud is assembled from a series of adjacent rings, each ring having an inner surface typically of one or more refractory materials such as ceramics. Each ring is formed of a circumferential series of arcuate segments. Each segment is attached to a surrounding framework such as a metal ring that is attached to the interior of the engine case. However, ceramic components are difficult to attach to other components. Ceramic material cannot be welded, and it is relatively brittle and weak in tension and shear, so it cannot withstand high stress concentrations. It differs from metal in thermal conductivity and growth, making it challenging to attach ceramic parts to metal parts in a hot and varying environment. Thus, efforts are being made to advance technologies for use of ceramic components in gas turbine engines, including technologies for reliable ceramic-to-metal connections.

An example of this advancement is disclosed in U.S. Pat. No. 6,758,653, which shows the use of a ceramic matrix composite (CMC) member connected to a metal support member. A CMC member using this type of connection can serve as the inner liner of a gas turbine engine shroud. Ceramic matrix composite materials typically include layers of refractory fibers in a matrix of ceramic. Fibers provide directional tensile strength that is otherwise lacking in ceramic. CMC material has durability and longevity in hot environments, and it has lower mass density than competing metals, making it useful for gas turbine engine components.

Further improvements in fabrication and attachment technologies for ceramic ring segments are desired.

BRIEF DESCRIPTION OF THE DRAWINGS

The invention is explained in following description in view of the drawings that show:

FIG. 4 shows a perspective view of a FIG. 1 with added sidewalls;

FIG. 5 shows a side sectional view of a component stem attachment mechanism using pins;

FIG. 6 shows a side sectional view of a component stem attachment mechanism using a ring clamp;

FIG. 7 shows a top partly sectional view taken on line 7 of FIG. 6

DETAILED DESCRIPTION OF THE INVENTION

Figure 1:
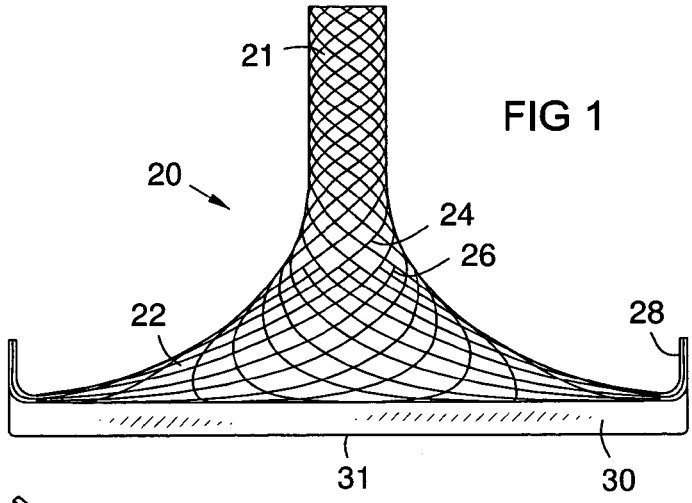
FIG. 1 schematically shows a side view of a refractory component, such as a shroud ring segment, according to an aspect of the invention.
Figure 2:
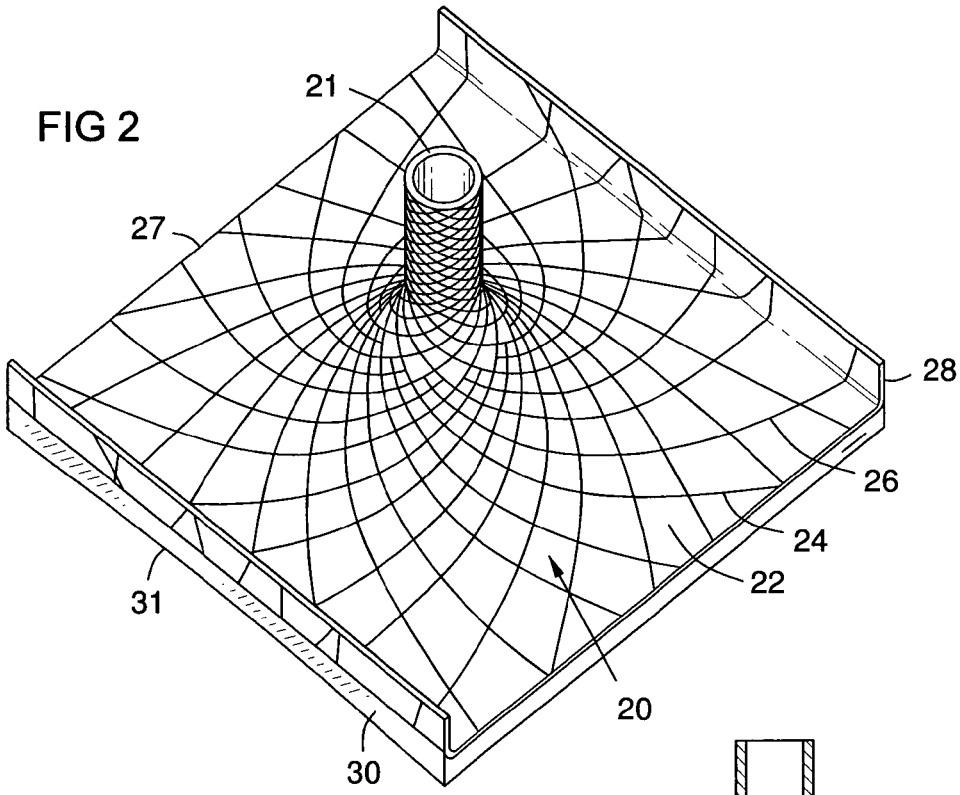
FIG. 2 shows a perspective view of a FIG. 1.
Figure 3:
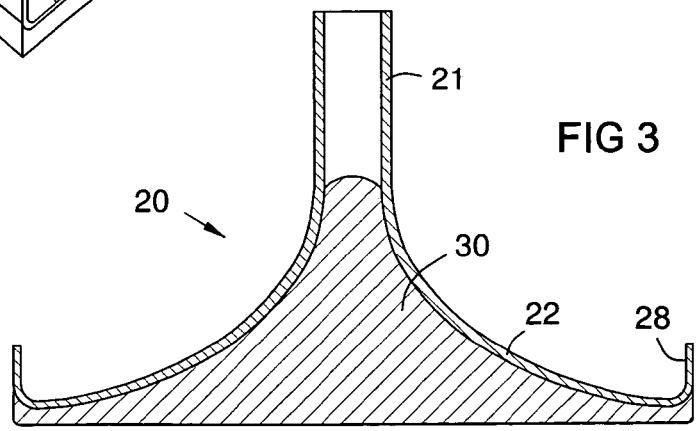
FIG. 3 shows a side sectional view of FIG. 1.

FIGS. 1-3 schematically show a shroud ring segment for a gas turbine engine comprising a flaired tube 20 with a stem 21 at a first end and a funnel-shaped portion 22 at a second end. The tube is formed of tows 24 and 26 of refractory fibers in a ceramic matrix. Some or all of the tows 24 may be continuous from end to end of the tube. Other tows 26 may start at intermediate stages in the diverging fabric to maintain a desired fabric density. The tows are shown sparsely in these drawings for visual clarity of the geometry. A ceramic core 30 at least partially fills the funnel-shaped portion 22, and provides a durable containment surface 31 for a working gas flow path.

Fiber tows 24 in this geometry can be either interwoven or overlaid. For example, in FIGS. 1-3 each tow 24 can alternately overlie and underlie alternate crossing tows in a plain weave forming a continuous braided tube 20. In this aspect of the invention a first subset of the tows 24 has a first orientation or warp, and a second subset of the tows 24 has a second orientation or weft. Weaving and braiding of ceramic fibers is a well known art, and can be done by machines, which reduces the risk of incorrect lay-ups, increases the fabrication speed and control, and reduces tolerances on the lay-up.

The shape of the flaired tube 20 may be defined by rotation of a curve and/or a line about an axis. This axis will be used herein for the terms "axis" and "axial". The surface area of the tube 20 increases dramatically from the first end 21 to the second end 22 for a given increment of distance along the axis. This tends to reduce the density of CMC fabric at the second end. Three options are suggested for increasing the fabric density at the second end: 1) additional tows 26 can be started at one or more intermediate stages along the flair 22 (FIGS. 1, 2, and 10); 2) the crossing angle between warp and weft tows 24 can increase from the first end 21 to the second end 22 (FIGS. 11 and 12); and 3) tows 24 in the stem 21 can be arranged in more layers than in the flair 22, providing thicker walls in the stem 21 and a higher fabric density the flair 22.

To form a flaired CMC tube 20, tows 24 may be woven into a braided tube then pulled over a funnel-shaped form made of a fugitive material that is lost during firing. The tows 24 may be impregnated with a wet ceramic matrix before or after pulling over the form. Alternately to using a pre-braided tube, the tows 24 may be laid in layers of different orientations on a fugitive form. In either case, the CMC may then be partly or fully cured at least to a point at which it is self-supporting. Then a core ceramic 30 may be poured into the funnel-shaped portion 22 to partly or completely fill the tube 20. Alternately, the core 30 may be independently formed by molding and/or machining then used as a form for stretching or laying the CMC fabric. Alternately, a flaired CMC tube 20 and a fitted core may 30 be formed separately, and the core 30 then placed into the funnel-shaped portion 22 with a refractory adhesive. Finally, the CMC tube 20 and the ceramic core 30 are fired together, bonding them.

Relative shrinkage between the CMC tube 20 and the core 30 during the final firing stage may be controlled by selecting compatible ceramic materials and by pre-curing the tube 20 and core 30 differently prior to mating them. These steps may provide matching shrinkage characteristics of the tube 20 and the core 30 during the final firing stage.

Backfilling the core material 30 into the funnel-shaped region functions to mechanically trap it and provides greater surface area for bonding as compared to applying the coating to a flat surface. The core 30 will also provide structural support to the CMC tube 20.

The funnel-shaped end 22 may be cut to have a generally rectangular shape 27. Some or all of these edges 27 may have curvature, depending on distance from the tube axis. For example edges 27 further from the tube axis may be straight, while closer edges may be curved. The gas containment surface 31 of the core 30 may be formed or machined as a cylindrical surface 31. This provides a shape that fits as a segment of a circular array as in a segment of a turbine shroud ring. At least some of the generally rectangular edges 27 of the funnel-shaped portion 22 may be turned back as shown in FIG. 2 to provide generally planar webbing 28 that stabilizes the edge and assists in gas sealing with adjacent segments or ring structures. Side plates 32 of metal or CMC may extend from a surrounding support structure to contact a back surface of the funnel-shaped portion 22 as in FIG. 4 to stabilize it and provide sealing with adjacent structures. Alternately, side plates 32 of CMC may be attached with refractory adhesive to at least some of the edges 27, 28 as in FIG. 4 for stabilizing and sealing, and also may provide attachment points onto surrounding structures.

FIG. 5 shows a stem attachment mechanism with pins 36 passing through the stem 21 and through a support housing 34, which may be of metal attached to a supporting structure. The core 30 may fill the stem 21 as well as the funnel 22, providing additional support for the pins 36 in this embodiment.

FIGS. 6 and 7 show a stem attachment mechanism comprising a plug 40 inserted into the stem 21. A ring clamp 38 constricts the stem 21 onto the plug 40. The end of the stem may have open-ended slots 41 to allow reduction of the diameter of the stem 21 when clamped. The clamp 38 may be a split ring tightened with a screw as shown or another known hoop constriction device. The plug 40 may be a rod of metal that is attached to surrounding support structure by threads, welding, or other known means.

Figure 8:
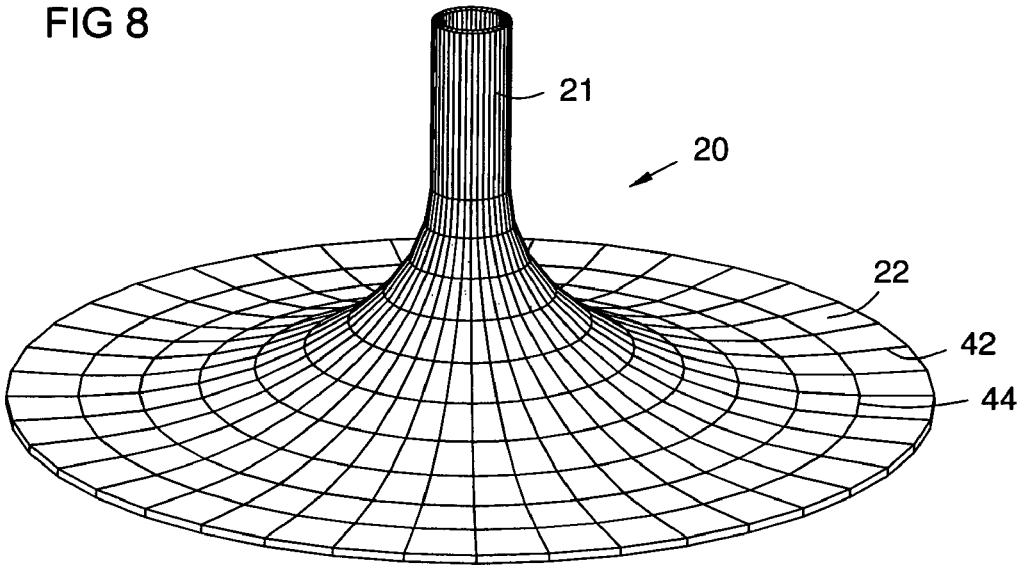
FIG. 8 schematically shows a perspective view of a second CMC fiber geometry.
Figure 9:
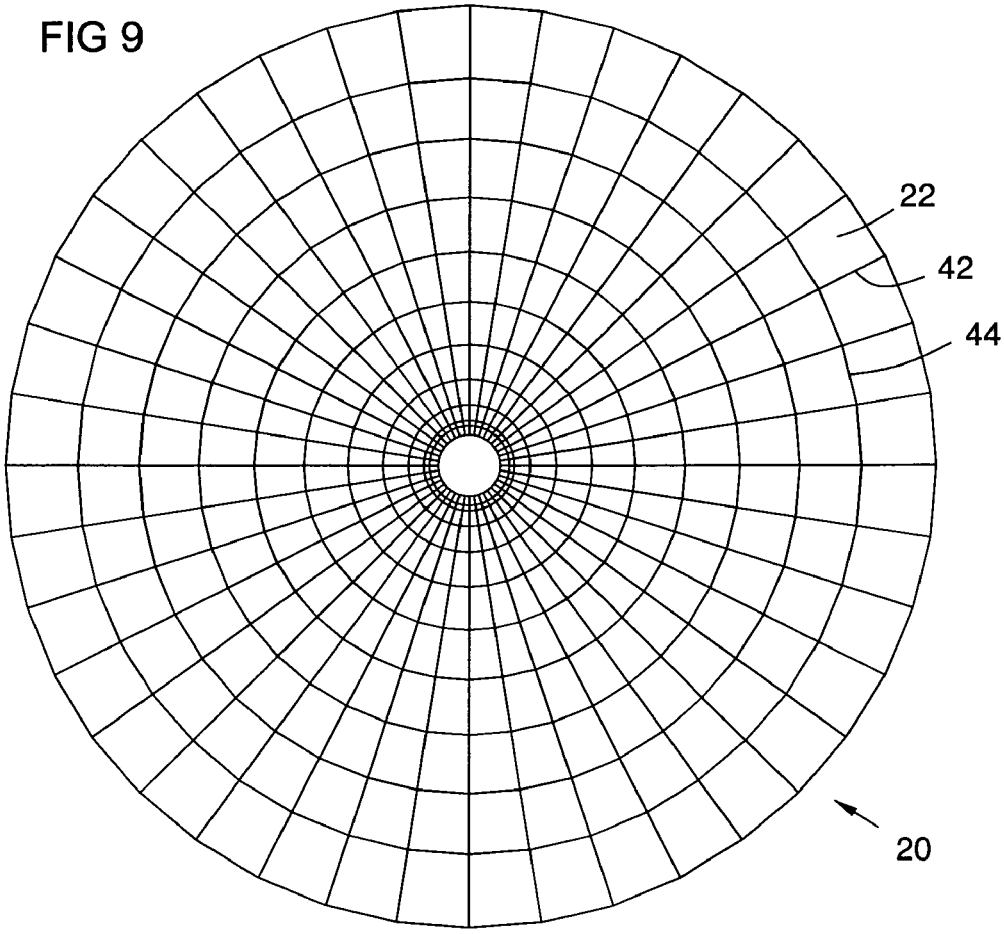
FIG. 9 schematically shows a top view of FIG. 8.
Figure 10:
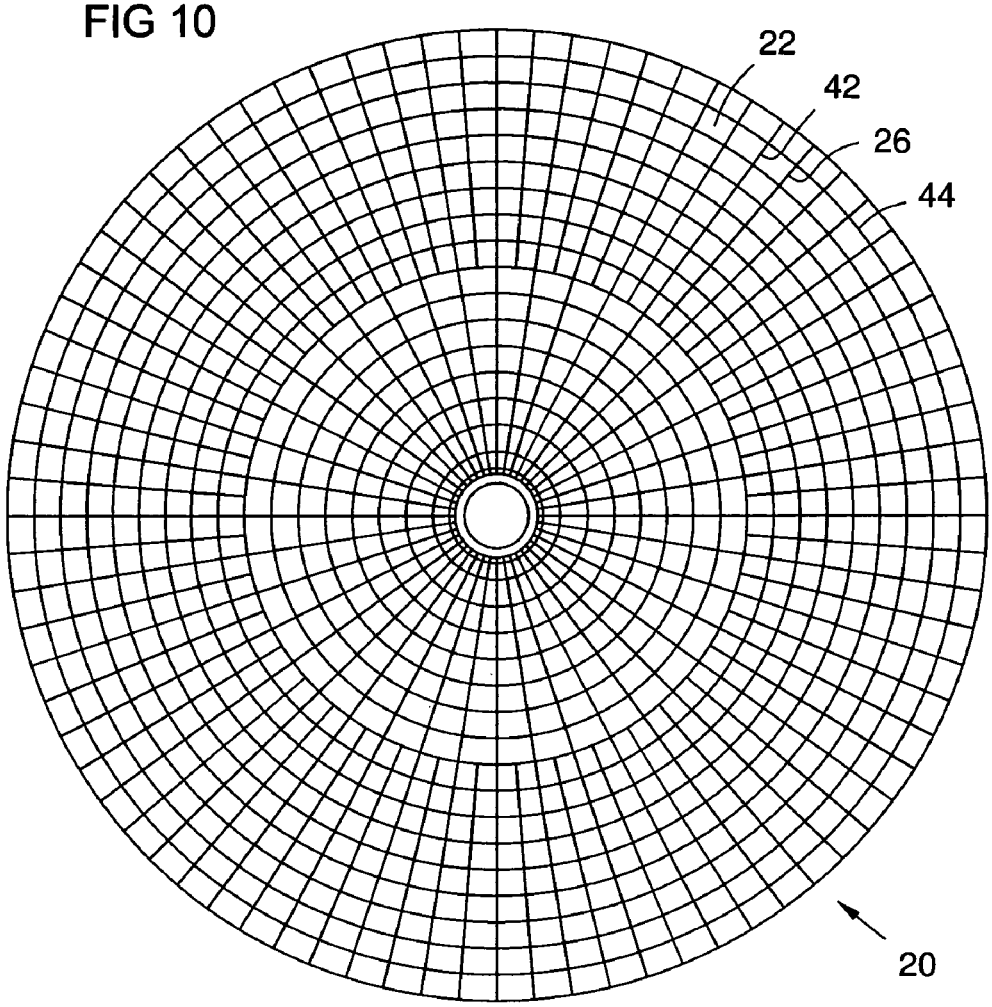
FIG. 10 shows a form of the geometry of FIGS. 8 and 9 with added intermediate tows.

FIGS. 8 and 9 show a second geometry for arranging fiber tows to form a flaired tube 20. Longitudinal tows 42 are parallel in the stem 21, and they diverge in the flair 22. Circumferential tows 44 can be spaced as desired. FIG. 9 shows how the fabric density is reduced as the radius of the flair 22 increases. FIG. 10 shows an addition of intermediate tows 26 and closer spacing of circumferential tows 44 to provide a desired fabric density at each radius of the flair 22.

Figure 11:
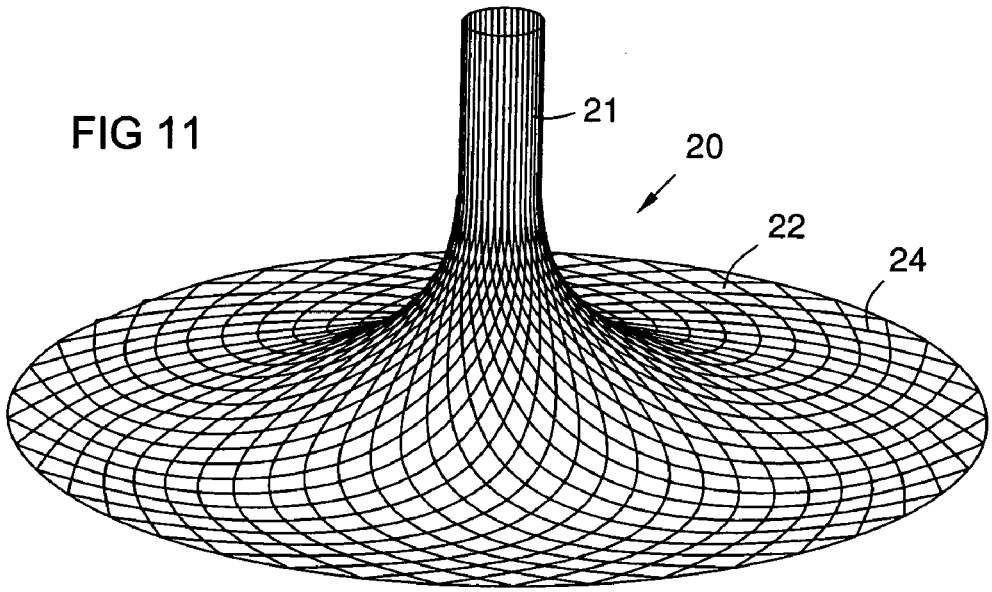
FIG. 11 schematically shows a perspective view of a third fiber geometry with parallel tows in two layers the stem diverging to a respective crossing tows with increasing crossing angles in the flaired end.
Figure 12:
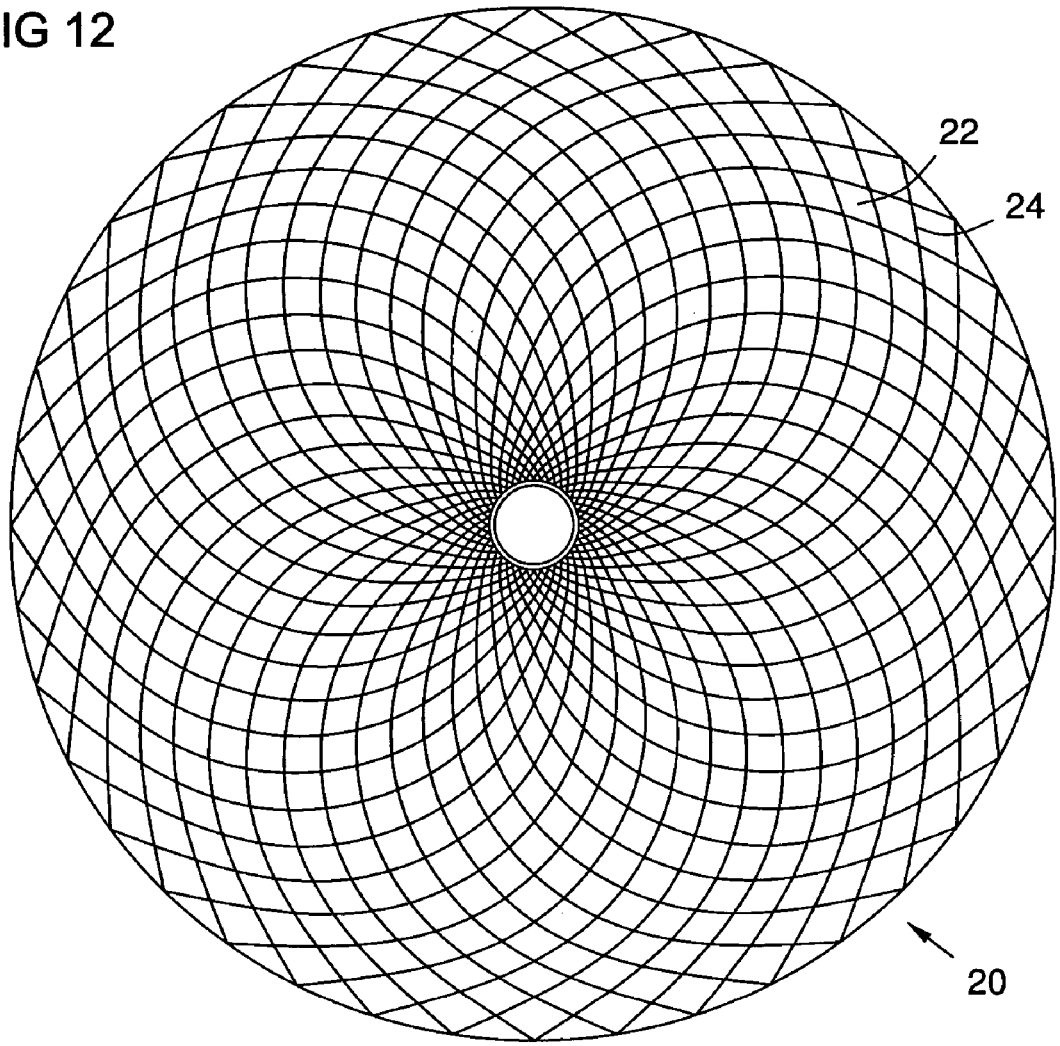
FIG. 12 shows a top view of FIG. 11.

FIGS. 11 and 12 show a third geometry for arranging fiber tows 24 to form a flaired tube 20. The tows 24 are parallel and in two layers in the stem. The two layers diverge into respective warp and weft tows 24 in the flair 22 to form crossing tows 24 with continuously increasing crossing angles. This increases the fabric density without the introduction of intermediate tows. For this reason, only continuous tows are needed in this geometry from end to end. Since the tows 24 are parallel in the stem 21, their crossing angles have room to increase from 0 degrees to about 90 degrees or more toward the flaired end without the tows becoming circumferential.

Although flaired tubes are shown as examples of the invention, conical tubes, or tubes with a cylindrical stem and a conical end can also use these CMC geometries.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A method for fabricating a refractory component for a gas turbine engine, comprising:

arranging a plurality of refractory fibers in a tubular geometry comprising a stem portion at a first end and a funnel-shaped portion at a second end;

impregnating the refractory fibers with a ceramic matrix;

at least partially filling the funnel-shaped portion of the tubular geometry with a ceramic core, and extending the ceramic core beyond the second end of the tubular geometry to form a gas containment surface;

joining the tubular geometry and the ceramic core; and providing an attachment mechanism on the stem portion of the tubular geometry.

2. The method of claim 1, wherein in the arranging step the refractory fibers are braided in a crossing pattern to form the tubular geometry.

3. The method of claim 1, wherein prior to the filling step the ceramic core is pre-formed with an outer surface that matches an inner surface of the funnel-shaped portion, and the filling step comprises inserting the preformed ceramic core into the funnel-shaped portion.

4. The method of claim 1, wherein prior to the arranging step the ceramic core is pre-formed, and the arranging step comprises laying the refractory fibers on the ceramic core as a form.

5. The method of claim 1, wherein the arranging step comprises arranging the refractory fibers in tows that increase in number from the first to second ends of the tubular geometry.

6. The method of claim 1, further comprising shaping the second end of the tubular geometry to comprise generally rectangular shape.

7. The method of claim 6, wherein at least two opposed generally rectangular edges of the second end of the tubular geometry are turned away from the second end of the tubular geometry to form generally planar stabilizing webs.

8. The method of claim 1, wherein the attachment mechanism comprises a support housing around the stem portion and a pin disposed through the support housing and the stem.

9. The method of claim 1, wherein the attachment mechanism comprises a plug inserted into an inner diameter of the stem portion and a clamping sleeve surrounding the stem portion that clamps the stem portion onto the plug.

10. The method of claim 1, further comprising shaping the containment surface as a cylindrically arcuate surface.

11. A refractory component formed by the method of claim 1.

12. A method for fabricating a shroud ring segment for a gas turbine engine, comprising:

arranging a plurality of refractory fibers in a tubular geometry comprising a stem portion at a first end and a funnel-shaped portion at a second end;

impregnating the refractory fibers with a ceramic matrix;

at least partially filling the funnel-shaped portion with a ceramic core extending beyond the second end of the tubular geometry to comprise a containment surface;

heat-curing the tubular geometry and the ceramic core;

cutting the second end of the tubular geometry to comprise generally rectangular edges; and shaping the containment surface as a cylindrical arc.

13. The method of claim 12, wherein in the arranging step the refractory fibers are arranged in some tows that are continuous from the first to second ends of the tubular geometry and additional tows that are introduced at intermediate positions along the funnel-shaped portion.

14. The method of claim 12, wherein at least two opposed generally rectangular edges of the second end of the tubular geometry are turned away from the second end of the tubular geometry to form generally planar stiffening webs.

15. A shroud ring segment formed by the method of claim 11.

16. A shroud ring segment for a gas turbine engine comprising:

a tubular ceramic matrix composite member comprising a stem portion at a first end and a funnel-shaped portion at a second end;

a ceramic core at least partially filling the tubular member and extending beyond the second end to define a gas containment surface;

an attachment mechanism for supporting the stem portion within the gas turbine engine.

17. The shroud ring segment of claim 16, wherein the ceramic matrix composite member comprises braided refractory fibers arranged in tows that increase in number from the first end to the second end.

18. The shroud ring segment of claim 16, wherein the second end of the ceramic matrix composite member and the extending portion of the ceramic core are formed to comprise a generally rectangular shape.

19. The shroud ring segment of claim 18, further comprising at least one edge of the ceramic matrix composite member second end being turned back to provide a generally planar webbing member.

* * * * *